United States Patent [19]

Boda

[11] Patent Number: 4,637,582

[45] Date of Patent: Jan. 20, 1987

[54] TOWEL RING ASSEMBLY

[75] Inventor: John W. Boda, Roscoe, Ill.

[73] Assignee: Amerock Corporation, Rockford, Ill.

[21] Appl. No.: 818,218

[22] Filed: Jan. 13, 1986

[51] Int. Cl.[4] ..... A47F 5/00

[52] U.S. Cl. ..... 248/315; D6/546

[58] Field of Search ..... 248/315, 309.1, 324; 16/124, 125, DIG. 24; 211/99, 100; D6/522, 546, 547, 548, 549, 550; 59/95

[56] References Cited

U.S. PATENT DOCUMENTS

| | | | |
|---|---|---|---|
| 1,464,311 | 8/1923 | Eriksen . | |
| 2,576,873 | 11/1951 | Zelov | 248/315 X |
| 2,701,114 | 2/1955 | Donaldson | 248/315 |
| 3,002,723 | 10/1961 | Daum | 248/315 |
| 3,102,636 | 9/1963 | Boone | 211/45 |
| 3,117,673 | 1/1964 | Hatfield et al. | 248/315 X |
| 3,660,861 | 5/1972 | Delmonico | D6/546 X |
| 3,894,707 | 7/1975 | Heard | 248/231 |

FOREIGN PATENT DOCUMENTS

| | | | |
|---|---|---|---|
| 0755150 | 11/1933 | France | D6/546 |

*Primary Examiner*—Ramon O. Ramirez

*Attorney, Agent, or Firm*—Leydig, Voit & Mayer, Ltd.

[57] ABSTRACT

A towel ring assembly comprising a split ring which swings in a pair of holes in a base is constructed so that the ring will not separate from the base when the ring is pulled with a heavy load. For this purpose, the base includes an integral web which is located between the holes and which is formed with a hole for receiving the screw of a fastener assembly. The fastener assembly ties the ends of the ring to one another and, when tightened, draws the ends of the ring toward the sides of the web. Lugs are formed integrally with the sides of the web and engage the ends of the ring to limit swinging of the ring beyond predetermined positions in either direction.

14 Claims, 11 Drawing Figures

TOWEL RING ASSEMBLY

BACKGROUND OF THE INVENTION

This invention relates to a towel ring assembly of the type in which a rigid base is mounted on a wall and supports a ring for upward and downward swinging.

More particularly, the invention relates to a towel ring assembly in which the base preferably is formed with a horizontal bore and in which the upper end of the ring is split to form opposed and spaced end portions. The end portions may be spread slightly to permit them to be alined with opposite ends of the bore and then may be released to enter the bore and support the ring on the base.

With most prior constructions, the end portions of the ring can be removed from the bore when the assembly is mounted and in service use and this may occur even accidentally. For example, a person may pull a towel on the ring in such a way that the towel does not slip off the ring but instead a heavy load is applied to the ring such that the ring yields and the end portions of the ring slip out of the bore. Separation of the ring and the base also may occur if a person attempts to use the ring as an aid to pull himself from a sitting position or grabs the ring in an attempt to prevent a fall.

Donaldson U.S. Pat. No. 2,701,114 discloses a towel ring assembly in which a split ring is positively captivated in holes in a base as long as the ring is hanging downwardly in a normal position. The ring, however, may separate from the base if the ring is turned to a position in which the ring is at a right angle to the wall.

Another towel ring assembly in which a split ring is positively captivated relative to the base is of the type disclosed in Wright U.S. application Ser. No. 428,395 (now abandoned), filed Sept. 29, 1982 and assigned to the assignee of the present invention. In that type of towel ring assembly, the bore in the base is formed with a lug which requires that the bore be cored with a back draft when the base is cast. Moreover, the assembly relies on the wall itself to prevent separation of the ring and the base and, as a result, it is possible for the ring to swing upwardly and mar the wall.

SUMMARY OF THE INVENTION

The general aim of the present invention is to provide a new and improved split ring towel ring assembly in which the ring is positively captivated relative to the base in a unique manner permitting the base to be more easily and economically manufactured, permitting the base and the ring to be formed with stops which prevent the ring from hitting the wall in either direction of swinging, and permitting the ring to withstand a heavier load without separating from the base.

A more detailed object of the invention is to achieve the foregoing by providing a towel ring assembly in which a projection located on the base and preferably within the bore is formed with a hole for pivotally receiving the screw of a fastener assembly which is carried by the ring. When the fastener assembly is tightened, the ends of the ring are drawn against opposite sides of the projection to attach the ring securely to the base while preventing accidental separation of the ends of the ring. Coacting stops may be formed in a simple manner on the sides of the projection and the ends of the ring to prevent the ring from hitting the wall in either direction of swinging.

The invention also resides in the novel construction of the end portions of the ring to receive the fastener assembly and to enable relatively quick and easy installation of the fastener assembly.

These and other objects and advantages of the invention will become more apparent from the following detailed description when taken in conjunction with the accompanying drawings.

DETAILED DESCRIPTION OF THE PREFERRED EMBODIMENT

Figure 1:
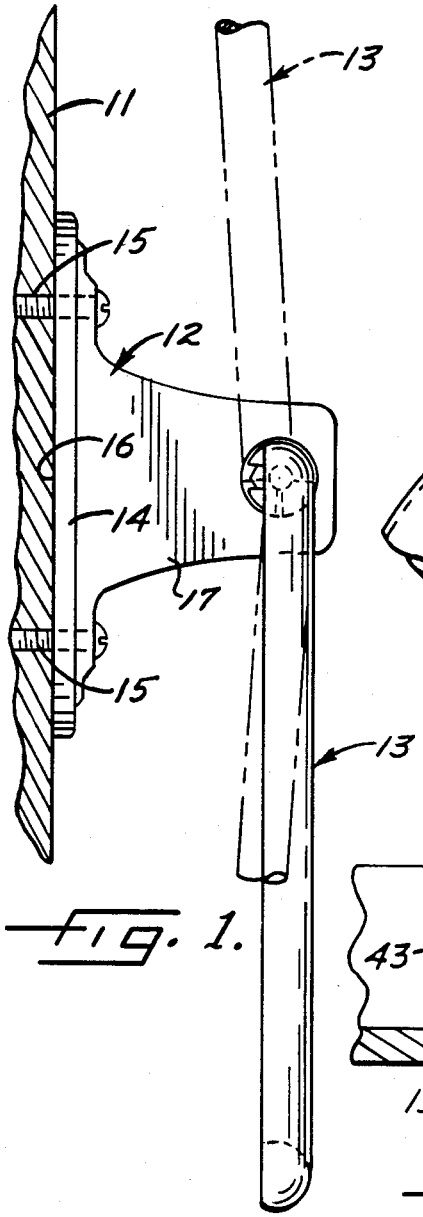
FIG. 1 is a side elevational view of a new and improved towel ring assembly incorporating the unique features of the present invention.

As shown in the drawings for purposes of illustration, the invention is embodied in a towel ring assembly adapted to be mounted on a vertical wall 11 and including a rigid base 12 and a ring 13 supported to swing on the base. The base preferably is a one-piece metal die casting having a substantially flat plate 14 secured to the wall 11 by screws 15 and formed with a rear surface 16 adapted to lie flat against the wall. Also formed as an integral part of the base 12 is an arm 17 which projects forwardly from the plate 14.

Figure 2:
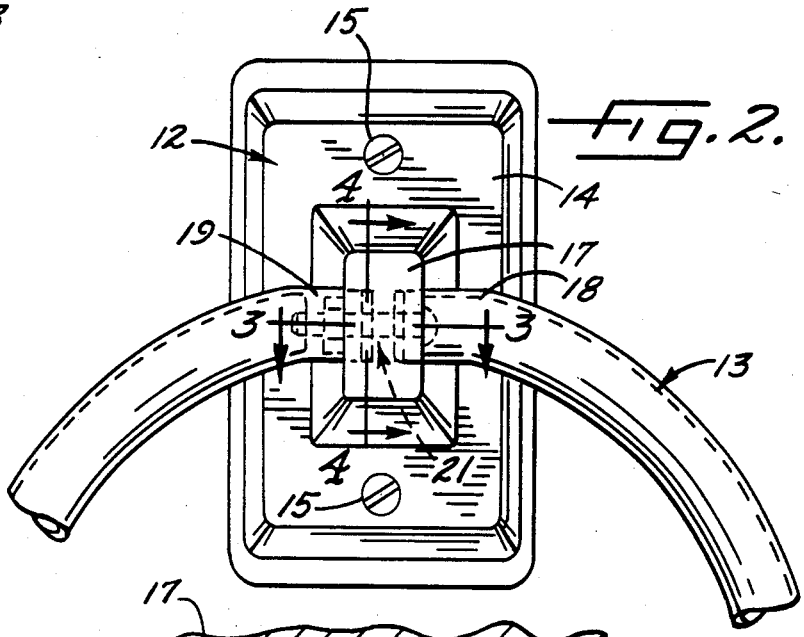
FIG. 2 is a fragmentary front elevational view of the towel ring assembly.

The ring 13, which is used for hanging a towel or the like, is generally circular in shape and is split along its upper side to provide end portions 18 and 19 whose extreme ends are spaced from and oppose one another. The end portions preferably are straight as shown in FIG. 2 rather than being arcuate as is the remainder of the ring. In this instance, the ring also is a metal casting.

In accordance with the present invention, the base 12 is formed with a forwardly extending projection or web 20 (FIG. 3) which coacts with a fastener assembly 21 to attach the split ring 13 to the base for up and down swinging while insuring against accidental separation of the ring from the base when the ring is subjected to a heavy load. As will become more apparent subsequently, the web 20 also coacts with the ends of the ring to prevent the ring from striking and marring the wall 11 in either direction of swinging of the ring.

More specifically, the web 20 is formed integrally with the arm 17 of the base 12 and is located in a vertically extending and laterally facing plane disposed midway between two laterally opening holes or bores 23 and 24 formed in the lateral sides of the arm. The bores 23 and 24 are circular in shape and define bore means for rotatably receiving the end portions 18 and 19, respectively, of the ring 13. For purposes of assembly, the ring is somewhat resilient so that the end portions 18 and 19 may be spread apart far enough to straddle the arm 17 until they are alined with and snap into the bores 23 and 24.

While snapping of the end portions 18 and 19 of the ring 13 into the bores 23 and 24 serves to attach the ring to the base 12, the snap fit is not sufficient to prevent the end portions from springing apart and pulling out of the bores if the ring is pulled with a heavy load. In carrying out the present invention, the fastener assembly 21 is used to positively attach the ring to the base and thereby prevent the ring from being accidentally separated from the base.

Figure 6:
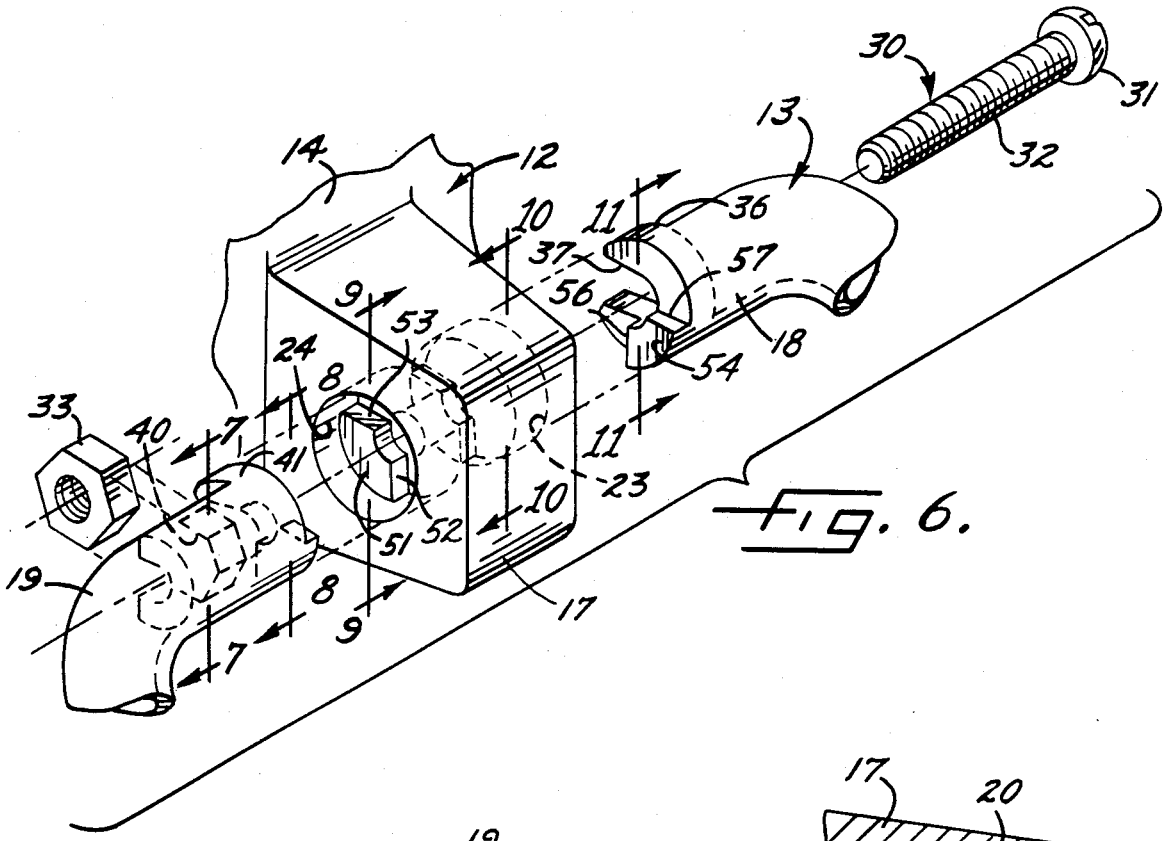
FIG. 6 is an exploded perspective view of certain parts of the towel ring, assembly.
Figure 9:
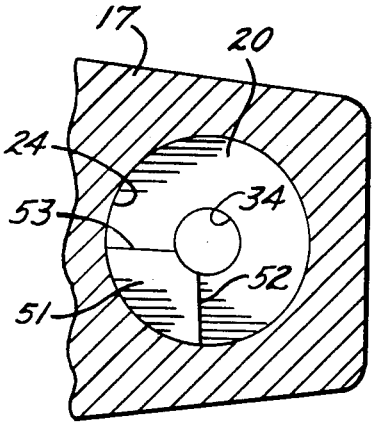
FIGS. 9 and 10 are enlarged fragmentary cross-sections taken substantially along the lines 9—9 and 10—10, respectively, of FIG. 6.

Herein, the fastener assembly 21 comprises a screw 30 (FIGS. 3 and 6) with an enlarged head 31 and an elongated shank 32 and further comprises a hex nut 33 adapted to threadably receive the shank. The shank 32 of the screw 30 is adapted to extend through a hole 34 (FIGS. 3 and 9) which is formed through the center of the web 20, the hole 34 being coaxial with and being substantially smaller in diameter than the bores 23 and 24. When the screw 30 is tightened, it coacts with the nut 33 to draw the ends of the ring together and, if desired, into frictional clamping engagement with the sides of the web 20.

Figure 3:
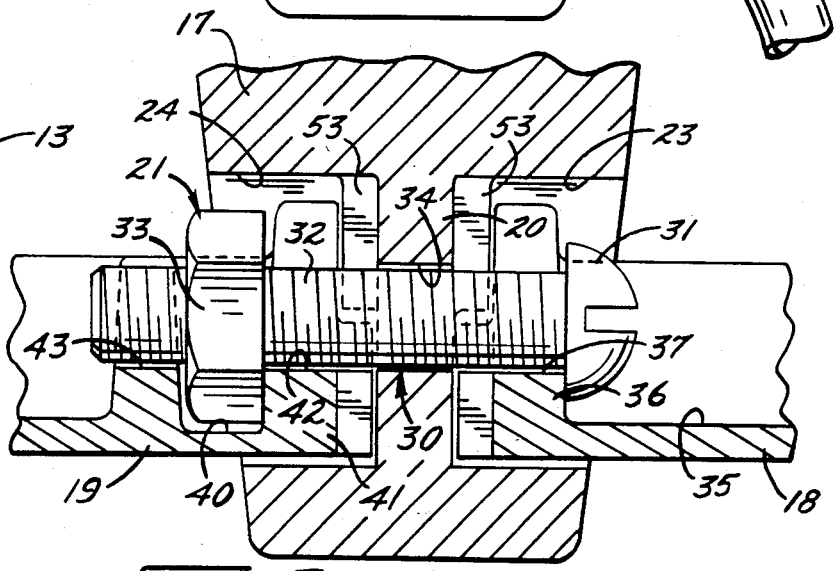
FIGS. 3 and 4 are enlarged fragmentary cross-sections taken substantially along the lines 3—3 and 4—4, respectively, of FIG. 2.
Figure 11:
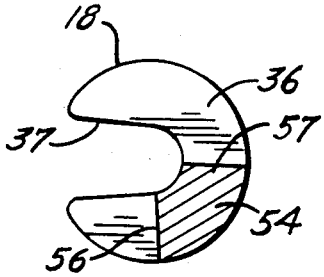
FIG. 11 is an enlarged cross-section taken substantially along the line 11—11 of FIG. 6.

As shown in FIG. 3, the head 31 of the screw 30 is located in a rearwardly opening cavity 35 formed in the rear side of the end portion 18 of the ring 13. The flat side of the head is disposed in opposing relation with and bears against one side of an ear 36 (FIGS. 3 and 6) formed integrally with and projecting rearwardly from the end portion 18 immediately adjacent the free end thereof. The portion of the screw shank 32 immediately adjacent the head 31 extends through the ear 36. While the ear could be formed with a hole to accommodate the shank 32, the shank herein is received in a rearwardly opening U-shaped notch 37 (FIG. 11) formed in the ear. Formation of the ear with the open notch 37 rather than a closed hole facilitates casting of the ear.

Figure 7:
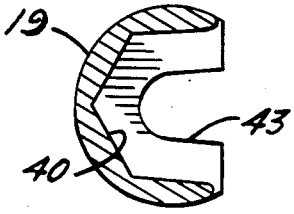
FIGS. 7 and 8 are enlarged cross-sections taken substantially along the lines 7—7 and 8—8, respectively, of FIG. 6.
Figure 8:
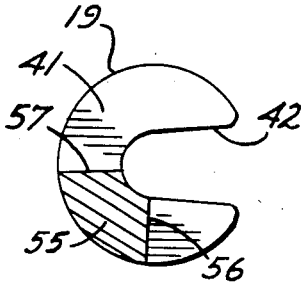

The nut 33 is located in a rearwardly opening cavity 40 (FIG. 3) formed in the rear side of the end portion 19 of the ring 13. As shown in FIG. 7, the cavity is formed with four flat sides which engage the flat sides of the nut 33 to prevent the latter from turning when the screw 30 is turned. The nut 33 is disposed in opposing relation with one side of an ear 41 formed integrally with and projecting rearwardly from the rear side of the ring end portion 19 adjacent the free end thereof. A rearwardly opening U-shaped notch 42 (FIG. 8) similar to the notch 37 is formed in the ear 41 and receives that portion of the screw shank 32 located between the nut and the web 20. Another U-shaped notch 43 (FIGS. 3 and 7) is formed in the rear side of the end portion 19 of the ring 13 and accommodates the free end portion of the screw shank 32.

To assemble the ring 13 to the base 12, the end portions 18 and 19 are resiliently spread apart, are placed in straddling relation with the arm 17 and then are released and permitted to snap into the holes 23 and 24. Thereafter, the nut 33 is inserted sidewise into the cavity 40 from the rear of the ring 13, the cavity being located outboard of the arm 17 and being unobstructed by the arm. The screw 30 then is placed sidewise into the cavity 35 and is inserted endwise through the ear 36, the hole 34 and the ear 41. When the screw is subsequently turned, it threads into the stationary nut 33 so as to cause the nut to draw up against the ear 41 and to cause the screw head 31 to draw up against the ear 36. Accordingly, the extreme ends of the ring 13 are drawn toward one another and may be drawn into engagement with the laterally facing sides of the web 20.

Thus, the screw 30 and the nut 33 tie the end portions 18 and 19 of the ring 13 securely to one another and prevent the end portions from separating and pulling out of the holes 23 and 24 when a heavy load is applied to the ring. When the ring swings within the holes 23 and 24, the screw 30 swings with the ring and turns within the hole 34. By loosening or tightening the screw, the clamping force between the ends of the ring and the web 20 may be decreased or increased to enable the ring to swing more freely or to restrict the swinging motion of the ring. Because the screw head 31 and the nut 33 are located in the cavities 35 and 40, the head is virtually flush with the rear side of the ring while the nut projects just a short distance beyond the rear side.

Figure 10:
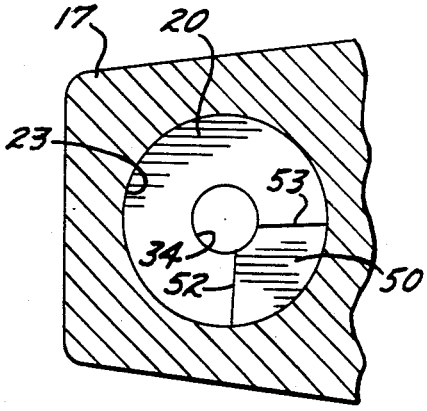

Advantageously, the incorporation of the web 20 in the base 12 enables the base to be easily formed with means for limiting both upward and downward swinging of the ring 13 beyond positions where the ring would strike and mar the wall 11. Herein, these means comprise two identical lugs 50 and 51 (FIGS. 9 and 10) located in the bores 23 and 24, respectively, and cast integrally with opposite sides of the web 20. Each lug is shaped generally as a circular quadrant and includes a generally vertical stop shoulder 52 and a generally horizontal stop shoulder 53. The lugs 50 and 51 coact with similarly shaped lugs 54 and 55 (FIGS. 8 and 11) formed on the extreme free ends of the ring end portions 18 and 19, respectively. Each of the lugs 54 and 55 is formed with a pair of angularly spaced shoulders 56 and 57.

Figure 4:
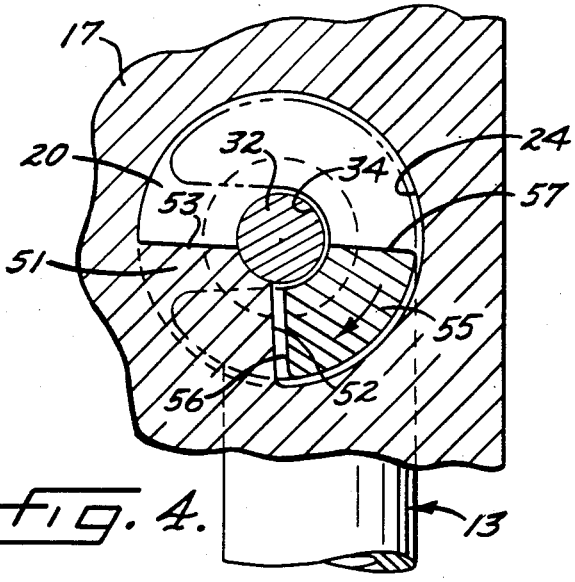
Figure 5:
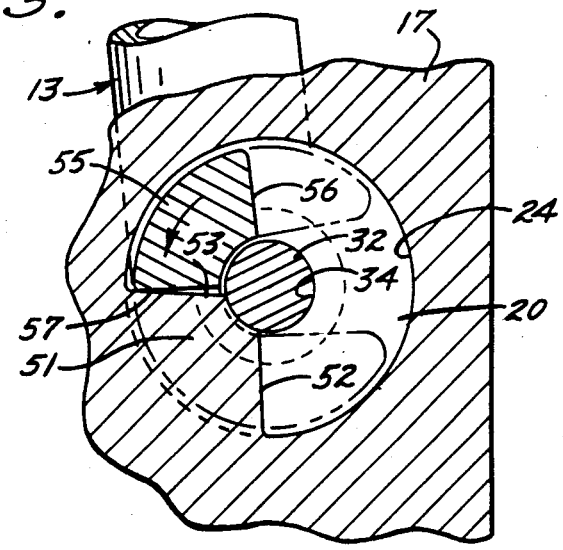
FIG. 5 is a view similar to FIG. 4 but shows the towel ring in a moved position.

When the ring 13 is hanging vertically in its normal position as shown in solid lines in FIG. 1, the shoulders 56 of the lugs 54 and 55 are positioned closely adjacent the shoulders 52 of the lugs 50 and 51 as shown in FIG. 4. If the ring is swung clockwise toward the wall as shown in phantom lines in FIG. 1, the shoulders 56 engage the shoulders 52 so as to stop the ring in the phantom line position and prevent the ring from striking the wall 11. Similarly, the shoulders 57 engage the shoulders 53 as shown in FIG. 5 if the ring is swung upwardly or counterclockwise to a substantially vertical position. Thus, the ring is prevented from striking the wall above the base 12 as well as below the base.

By virtue of the web 20, the lugs 50 and 51 may be cast integrally with the sides of the web and may be located within the bores 23 and 24 without need of coring the bores with a back draft angle. Accordingly, the base 12 may be cast in a relatively simple manner.

I claim:

1. A towel ring assembly comprising, in combination, a base having a rear surface adapted to be attached to a wall or the like, a forwardly extending projection on said base and formed with a generally horizontal hole having an axis extending generally parallel to the wall, a split ring having first and second end portions spaced from one another, and located on opposite laterally facing sides of said projection, a fastener assembly comprising a nut and comprising a screw having a head and having a shank extending through said hole and threaded into said nut, first and second ears on the rear sides of the first and second end portions, respectively, of said ring, said first ear being located between said head and one side of said projection in opposing engagement with said head and receiving a portion of said shank, and said second ear being located between said nut and the opposite side of said projection in opposing relation with said nut and receiving another portion of said shank whereby tightening of said fastener assembly causes said head and nut to bear against said ears and to draw the ends of said ring toward said projection while permitting said ring to swing relative to said projection.

2. A towel ring assembly as defined in claim 1 in which said base is formed with bores located on opposite sides of said projection. said bores being coaxial with said hole, being larger in diameter than said hole and rotatably receiving the end portions of said ring.

3. A towel ring assembly as defined in claim 1 in which said ears are formed with rearwardly opening notches which receive said shank.

4. A towel ring assembly as defined in claim 1 in which first and second rearwardly opening cavities are formed in the rear sides of the first and second end portions, respectively, of said ring, said head and said nut being received in said first and second cavities, respectively.

5. A towel ring assembly as defined in claim 4 in which said second cavity is shaped to prevent turning of said nut when said screw is turned.

6. A towel ring assembly as defined in claim 1 further including means formed integrally with at least one side of said projection and engageable with the adjacent end portion of said ring to limit swinging of said ring beyond a predetermined position.

7. A towel ring assembly comprising, in combination, a base having a rear surface adapted to be attached to a wall or the like, a portion of said base projecting forwardly of said rear surface and having opposite laterally facing sides formed with first and second laterally extending bores, a split ring having first and second end portions spaced from one another and located to turn within said first and second bores, respectively, said base having a web located between the ends of said ring and formed with a laterally extending hole smaller in diameter than said bores, a fastener assembly comprising a nut and comprising a screw having a head and having a shank extending through said hole and threaded into said nut, a first cavity formed in the rear side of the first end portion of said ring and receiving said head, a first ear on the rear side of the first end portion of said ring between said head and one side of said web, said first ear being disposed in opposing engagement with said head and receiving a portion of said shank, a second cavity formed in the rear side of the second end portion of said ring and receiving said nut, a second ear on the rear side of the second end portion of said ring between said nut and the opposite side of said web, and said second ear being disposed in opposing engagement with said nut and receiving another portion of said shank whereby tightening of said fastener assembly causes said head and said nut to bear against said ears and to draw the ends of said ring toward the sides of said web while permitting said ring to swing relative to said web.

8. A towel ring as defined in claim 7 in which said cavities open rearwardly out of the rear side of said ring and in which said ears are formed with rearwardly opening notches for receiving said shank.

9. A towel ring as defined in claim 7 further including first and second stop lugs formed integrally with the sides of said web and located within said first and second bores, respectively, said stop lugs having means engageable with the ends of said ring to prevent swinging of said ring beyond a predetermined position in either direction.

10. A towel ring assembly comprising, in combination, a base having a rear surface adapted to be attached to a wall or the like, a portion of said base projecting forwardly of said rear surface and formed with elongated and generally horizontal bore means having an axis extending generally parallel to the wall, a split ring having first and second end portions opposing each other and located in opposite ends of said bore means, a fastener assembly comprising a nut and comprising a screw having a head and having a shank threaded into said nut, a first cavity opening rearwardly out of the rear side of the first end portion of said ring and receiving said head, a second cavity opening rearwardly out of the rear side of the second end portion of said ring and receiving said nut, first and second ears on the rear sides of the first and second end portions, respectively, of said ring and being disposed between said head and said nut, said first ear receiving a portion of said shank and being disposed in opposing relation with said head, said second ear receiving another portion of said shank and being disposed in opposing relation with said nut whereby tightening of said fastener assembly causes said head and said nut to bear against said ears and to draw the end portions of said ring toward one another.

11. A towel ring assembly as defined in claim 10 in which said second cavity is shaped to prevent turning of said nut when said screw is turned.

12. A towel ring assembly as defined in claim 11 in which said cavities open rearwardly out of the rear side of said ring and in which said ears are formed with rearwardly opening notches for receiving said shank.

13. A towel ring assembly as defined in claim 10 in which said base is formed with a web located within said bore means and dividing the latter into first and second bores receiving the first and second end portions, respectively, of said ring, a hole formed through said web, said hole being smaller in diameter than said bores and being coaxial with said bores, and said screw extending through said hole whereby tightening of said fastener assembly is operable to draw the ends of said ring into clamping engagement with opposite sides of said web.

14. A towel ring assembly as defined in claim 13 further including a lug formed integrally with one side of said web and located in one of said bores, said lug having means engageable with the adjacent end portion of said ring to limit swinging of said ring beyond a predetermined position in either direction.

* * * * *